US011175093B1

(12) United States Patent
Morimoto et al.

(10) Patent No.: US 11,175,093 B1
(45) Date of Patent: Nov. 16, 2021

(54) VACUUM FREEZE-DRYING APPARATUS AND VACUUM FREEZE-DRYING METHOD

(71) Applicant: MII Ltd., Osaka (JP)

(72) Inventors: Shuji Morimoto, Osaka (JP); Makoto Takehara, Osaka (JP)

(73) Assignee: MII Ltd.

( * ) Notice: Subject to any disclaimer, the term of this patent is extended or adjusted under 35 U.S.C. 154(b) by 0 days.

(21) Appl. No.: 17/235,358

(22) Filed: Apr. 20, 2021

(30) Foreign Application Priority Data

May 18, 2020 (JP) ..... JP2020-086651

(51) Int. Cl.
*F26B 5/06* (2006.01)

(52) U.S. Cl.
CPC ..... *F26B 5/06* (2013.01)

(58) Field of Classification Search
CPC .... F26B 5/06; F26B 5/04; F26B 5/041; F26B 5/042; F26B 5/065; F26B 15/26; F26B 17/18; F26B 17/20; F26B 15/00; F26B 15/04
USPC ..... 34/403
See application file for complete search history.

(56) References Cited

U.S. PATENT DOCUMENTS 430,652 A * 6/1890 Jarrett ..... F26B 17/20 34/182
474,568 A * 5/1892 Weller ..... F26B 17/20 34/182
548,573 A * 10/1895 Moller et al. ..... F26B 5/06 34/76
676,165 A * 6/1901 Wacker ..... F26B 17/20 34/182
1,172,479 A * 2/1916 Motter ..... F27B 17/00 432/66
1,179,192 A * 4/1916 Kleinschmidt ..... F27B 17/00 432/66
2,388,917 A * 11/1945 Hormel ..... F26B 5/06 34/295
2,411,152 A * 11/1946 Folsom ..... F26B 5/06 34/295

(Continued)

FOREIGN PATENT DOCUMENTS

CA 2949789 A1 * 12/2016 ..... F26B 23/00
GB 2110803 A * 6/1983 ..... F26B 17/20

(Continued)

*Primary Examiner* — Jorge A Pereiro
*Assistant Examiner* — Bao D Nguyen
(74) *Attorney, Agent, or Firm* — Lerner, David, Littenberg, Krumholz & Mentlik, LLP

(57) ABSTRACT

Provided is a vacuum freeze-drying apparatus 1, having a drying device 3 provided with an inlet portion and an outlet portion and comprising a tubular member 31 formed of a tubular shape, a temperature adjusting means 30*a* to 30*j* provided in a plurality of regions 40*a* to 40*j* in a direction from the inlet portion to the outlet portion in a peripheral portion of the tubular member for adjusting a temperature of the plurality of regions in an outer surface of the tubular member, a temperature control unit 8 for independently controlling the temperature adjusting means, and a rotating portion 7 for rotating the tubular member, wherein the tubular member has a spiral transfer means 31*a* for transferring the frozen substance entering from the inlet portion sequentially to locations corresponding to the plurality of regions in the tubular member to continuously sublimate and dry the frozen substance.

11 Claims, 11 Drawing Sheets

(56) References Cited

U.S. PATENT DOCUMENTS 2,616,604 A * 11/1952 Folsom ..... F26B 5/06 53/432
2,751,687 A * 6/1956 Colton ..... A23F 5/32 264/28
2,803,888 A * 8/1957 Santiago ..... F26B 5/06 34/62
3,088,222 A * 5/1963 Mace ..... F26B 5/06 34/92
3,316,652 A * 5/1967 Van Gelder ..... F26B 5/06 34/292
3,469,327 A * 9/1969 Catelli ..... F26B 5/06 34/92
3,531,872 A * 10/1970 Watson ..... F26B 3/00 34/315
3,952,541 A * 4/1976 Rigoli ..... B01D 9/04 62/381
4,037,331 A * 7/1977 Brilloit ..... F26B 5/06 34/92
5,964,043 A * 10/1999 Oughton ..... F26B 5/06 34/92
2008/0142166 A1* 6/2008 Carson ..... B01D 9/0027 159/4.01
2011/0192047 A1 8/2011 Itou et al.
2021/0080179 A1 3/2021 Nishihashi et al.

FOREIGN PATENT DOCUMENTS

JP S47021743 A 10/1972
JP S51126557 A 11/1976
JP S55112980 A 9/1980
JP 2004232883 A * 8/2004
JP 3117061 U 1/2006
WO WO-8909638 A1 * 10/1989 ..... B09C 1/06
WO 2010005021 A1 1/2010
WO WO-2013036107 A2 * 3/2013 ..... F26B 5/06
WO 2013050162 A1 4/2013
WO 2019235036 A1 12/2019

* cited by examiner

VACUUM FREEZE-DRYING APPARATUS AND VACUUM FREEZE-DRYING METHOD

CROSS-REFERENCE TO RELATED APPLICATION

The present application claims priority from Japanese Patent Application No. 2020-086651 filed with the Japanese Patent Office on May 18, 2020, the disclosure of which is hereby incorporated herein by reference.

DETAIL DESCRIPTION OF THE INVENTION

Technology Field

The present disclosure relates to a vacuum freeze-drying apparatus and a vacuum freeze-drying method.

BACKGROUND

Conventionally, a freeze-drying apparatus has been proposed in which droplets are produced, the droplets are freeze-solidified, and the frozen particles are freeze-dried (Patent Document 1).

In addition, a freeze-drying apparatus has also been proposed in which a shelf for receiving frozen materials is tilted (Patent Document 2).

Further, a vacuum freeze-drying apparatus has been proposed in which frozen particles are sublimated and dried by the kinetic energy obtained at the time of spraying (Patent Document 3).

PRIOR ART DOCUMENTS

Patent Documents

Patent Document 1 WO2013/050162
Patent Document 2 WO2010/005021
Patent Document 3 WO2019/235036

SUMMARY OF THE INVENTION

Problem to be Solved by the Invention

However, the above documents have a problem that vacuum freeze-drying cannot be continuously performed in a short time.

Therefore, the present invention has been made in view of the above problems and provides a vacuum freeze-drying apparatus and a vacuum freeze-drying method capable of continuously performing vacuum freeze-drying in a short time.

Solution to the Problem

In order to solve the above problems, (1) the present invention provides a vacuum freeze-drying apparatus comprising a vacuum freezing device for freezing a liquid, a drying device for sublimating and drying a frozen substance frozen as above, and an exhaust path for performing vacuum suction. The drying device comprises a tubular member formed of a tubular shape provided with an inlet portion and an outlet portion. Also comprised is a temperature adjusting means in a plurality of regions in a direction from the inlet portion to the outlet portion in a peripheral portion of the tubular member, wherein the plurality of regions are at least three or more regions whose temperature is capable of being controlled, wherein the temperature adjusting means is for adjusting a temperature of the plurality of regions in an outer surface of the tubular member. Also comprised are a temperature control unit for independently controlling the temperature adjusting means, and a rotating portion for rotating the tubular member. The tubular member has a spiral transfer means continuously provided adjacent to an inner wall of the tubular member in a direction from the inlet portion to the outlet portion, and the transfer means transfers the frozen substance entering from the inlet portion sequentially to locations corresponding to the plurality of regions in the tubular member to continuously sublimate and dry the frozen substance.

(2) In the configuration of the above (1), the plurality of regions of the three or more regions comprise at least a first temperature region of a minus temperature, a second temperature region in a range from the minus temperature to the minus temperature plus 40° C., and a third temperature region of the upper limit of the second temperature region plus 20° C. or higher, provided in a direction from the inlet portion to the outlet portion respectively.

(3) In the configuration of the above (1) or (2), a substance produced therefrom is an injectable substance or a drug in solid formulation, and a periphery of a tubular member is covered with clean air.

(4) In the configuration of the above (1) to (3), the rotating portion comprises a rotational drive transmitting portion for transmitting rotational drive provided in one or a plurality of locations in an axial direction, and a rotation support portion configured by a rotary roller and/or a bearing for supporting rotation by the rotational drive transmitting portion.

(5) In the configuration of the above (1) to (4), the rotating portion has a rotation speed of 1/30 rpm or more and 1 rpm or less.

(6) In the configuration of the above (1) to (5), the transfer means is formed by providing a spiral wall portion in an inner wall of the tubular member.

(7) In the configuration of the above (1) to (6), the transfer means is configured by a groove portion formed in an inner wall of the tubular member, and the depth of the groove portion is 3 mm or more and 50 mm or less.

(8) In the configuration of the above (1) to (7), the temperature adjusting means adjusts a temperature of each region of the tubular member by respectively adjusting a temperature of a space surrounding the tubular member.

(9) In the configuration of the above (1) to (8), the tubular member includes a contact type or non-contact type temperature detection unit, and the temperature control unit controls a temperature adjusted by the temperature adjusting means according to a surface temperature of the tubular member or a temperature of a substance in the tubular member detected by the temperature detection unit.

(10) In the configuration of the above (1) to (9), a moisture detection unit is provided outside the tubular member for detecting moisture content of a substance in the tubular member through a transparent glass or resin window portion, and the temperature control unit controls a temperature adjusted by the temperature adjusting means according to the amount of moisture of substance in the tubular member detected by the moisture detection unit.

(11) In the configuration of the above (1) to (10), the tubular member is made of stainless steel.

(12) The present invention provides a vacuum freeze-drying method comprising a vacuum freezing step of freezing a liquid, a drying step of sublimating and drying a frozen substance frozen as above, and a step of performing vacuum suction through an exhaust path. Included in the drying step is a tubular member formed of a tubular shape having an inlet portion and an outlet portion, comprising a step of rotating a tubular member having a spiral transfer means continuously provided adjacent to an inner wall of a tubular member in a direction from an inlet portion to an outlet portion, a step of adjusting temperatures of a plurality of regions provided in a direction from an inlet portion to an outlet portion in a peripheral portion of the tubular member, wherein the plurality of regions are at least three or more regions whose temperature is capable of being controlled, and a step of continuously sublimating and drying the frozen substance while the frozen substance entering from the inlet portion is transferred sequentially to locations corresponding to the plurality of regions in the tubular member.

Effect of the Invention

According to the present invention, it enables to provide a vacuum freeze-drying apparatus and a vacuum freeze-drying method capable of continuously performing vacuum freeze-drying in a short time.

DESCRIPTION OF EMBODIMENTS

Figure 1:
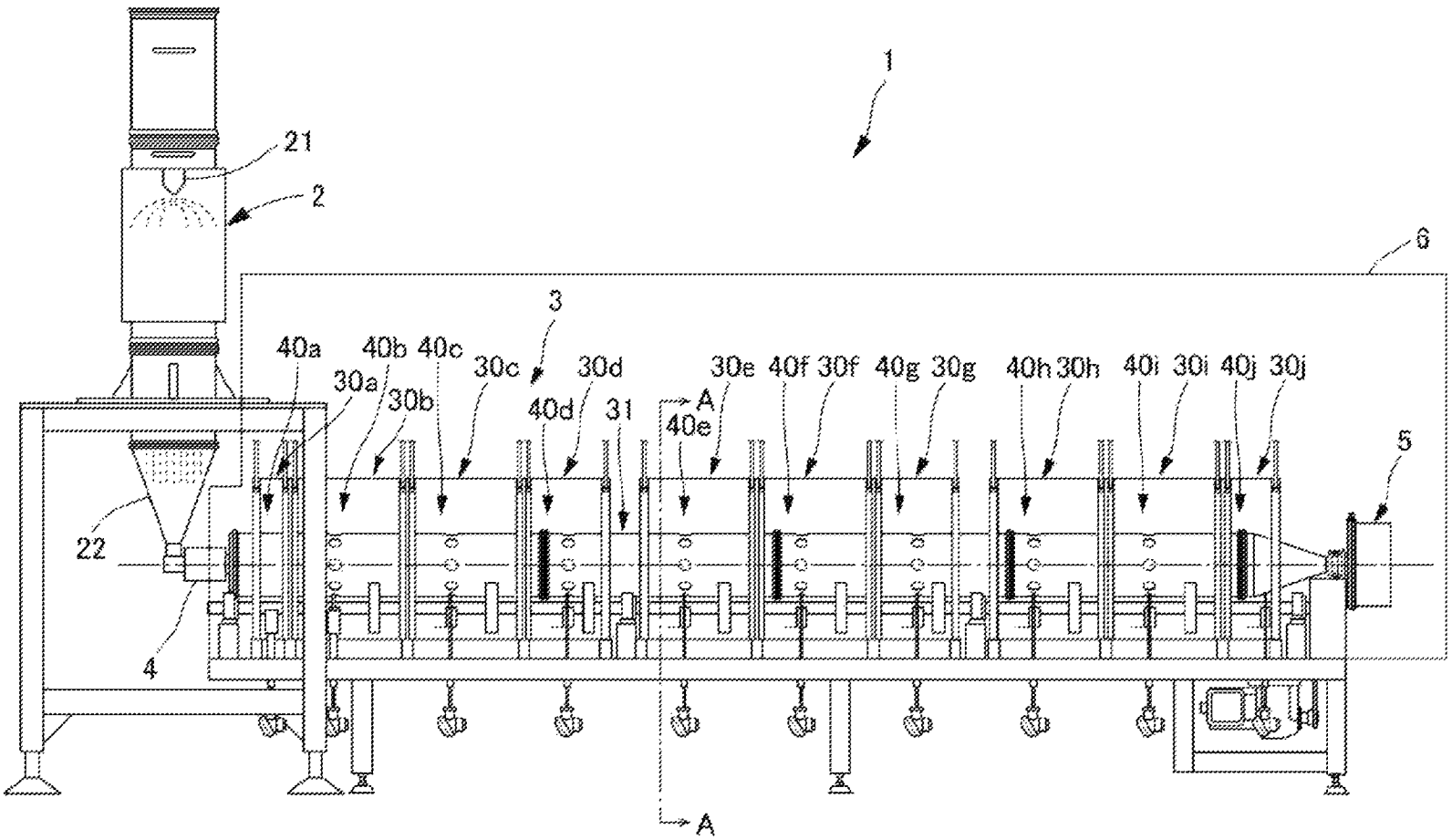
FIG. 1 is an explanatory diagram of a vacuum freeze-drying apparatus according to an embodiment to the present invention.

Next, a vacuum freeze-drying apparatus according to an embodiment to the present invention will be described. Further, the same member or a member having the same function may be designated by the same reference numeral, and the description may be omitted as appropriate after the member is described.

Figure 2:
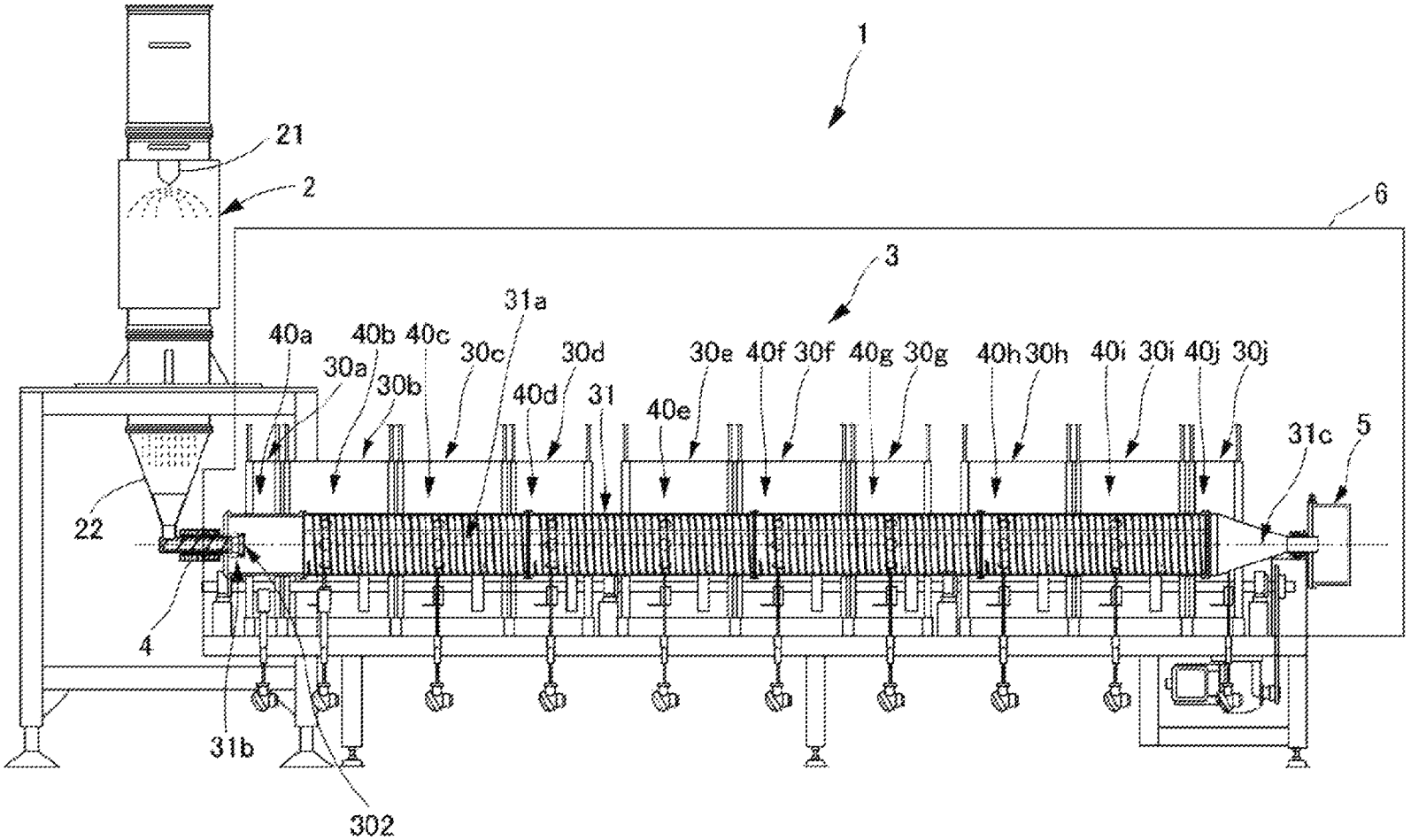
FIG. 2 is a cross-sectional view of a drying device, a connection portion, and a collection portion in a vacuum freeze-drying apparatus in FIG. 1.

FIG. 1 is an explanatory diagram of a vacuum freeze-drying apparatus according to an embodiment to the present invention. FIG. 2 is a cross-sectional view of a drying device, a connection portion, and a collection portion in a vacuum freeze-drying apparatus in FIG. 1.

As shown in FIG. 1, a vacuum freeze-drying apparatus 1 has a vacuum freezing device 2, a drying device 3, a connection portion 4, and a collection portion 5.

Substance handled by a vacuum freeze-drying apparatus 1 is an injectable substance or a drug in solid formulation.

A vacuum freezing device 2, for example, sprays a raw material solution containing a raw material into a vacuum container from a spray nozzle 21 to produce a frozen substance by freezing a sprayed raw material solution. Further, a vacuum freezing device may be one in which a raw material solution is dropped from a nozzle into a vacuum container to produce a frozen substance by freezing dropped droplets. A sprayed or dropped raw material solution self-freezes due to an evaporation of water during the fall and the deprivation of latent heat of vaporization, resulting in a frozen substance which is a fine frozen particle. A frozen substance falls toward a collection portion 22 having a tapered shape with a smaller opening, and is collected by the collection portion 22.

A connection portion 4 connects a vacuum freezing device 2 and a drying device 3 for transporting a frozen substance produced at a vacuum freezing device 2 to a drying device 3.

A drying device 3 is to continuously sublimate and dry a frozen substance. A collection portion 5 collects a dried material since it is formed by sublimating and drying at a drying device 3 to be evolved from an outlet portion 31*c* of a tubular member 31.

A vacuum freeze-drying apparatus 1 has an exhaust path for performing vacuum suction, wherein the exhaust path is provided in a connection portion 4 according to an embodiment. An exhaust path may be provided in a vacuum freezing device 2, a drying device 3, or a connection portion 4. By providing an exhaust path, it enables to maintain reduced-pressure atmosphere inside, to make it difficult for liquid to be present, and to make a circumstance where solid or gas is present.

A tubular member 3 and a collection portion 5 are covered by clean air 6 in the periphery. Any surrounding outer surface portion of a decomposable connecting portion of a tubular member 3 is all covered by clean air 6 so that it is configured to allow clean air to enter against a leak.

Figure 3:
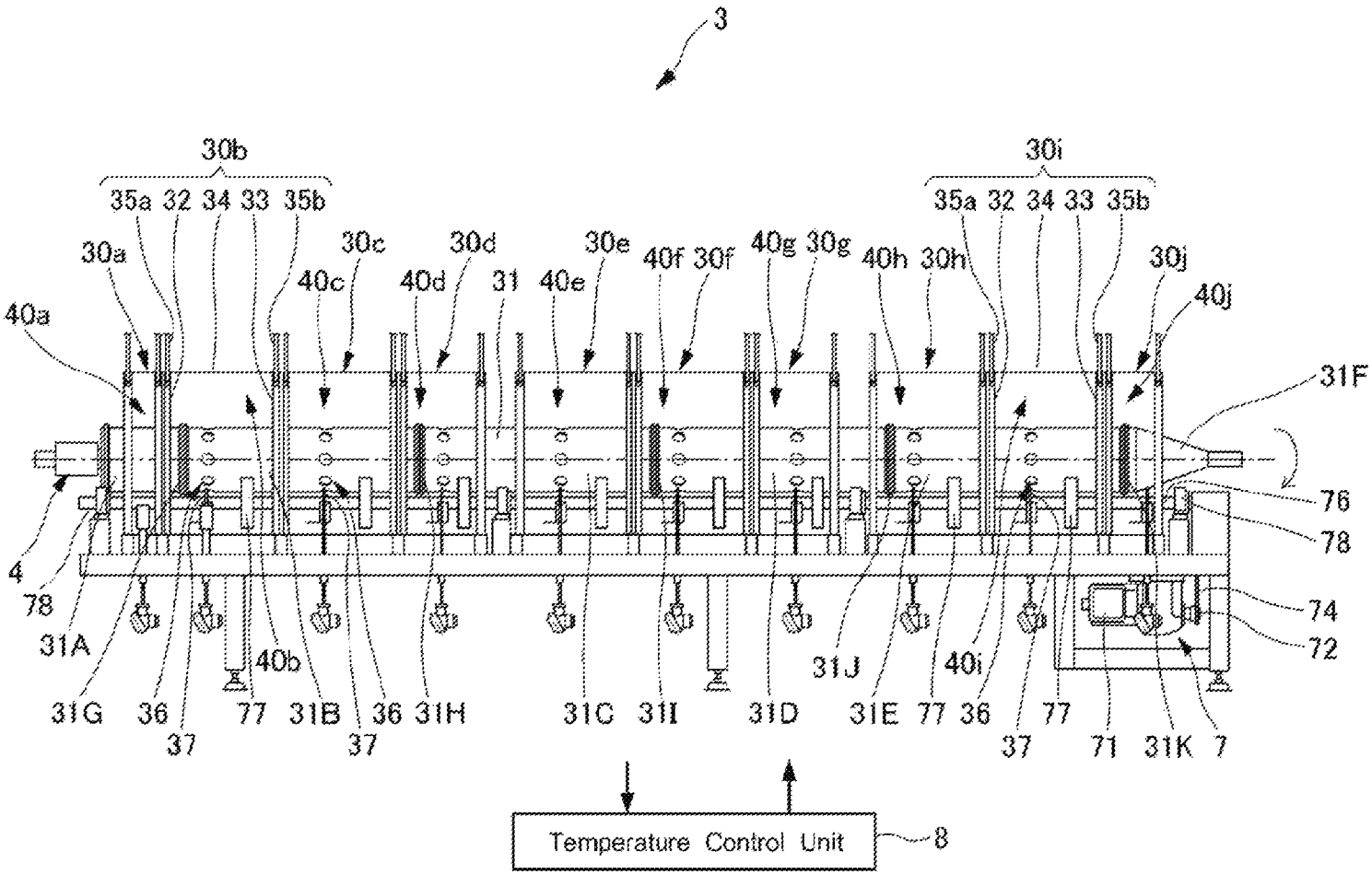
FIG. 3 is a front view of a drying device of a vacuum freeze-drying apparatus according to an embodiment to the present invention.
Figure 4:
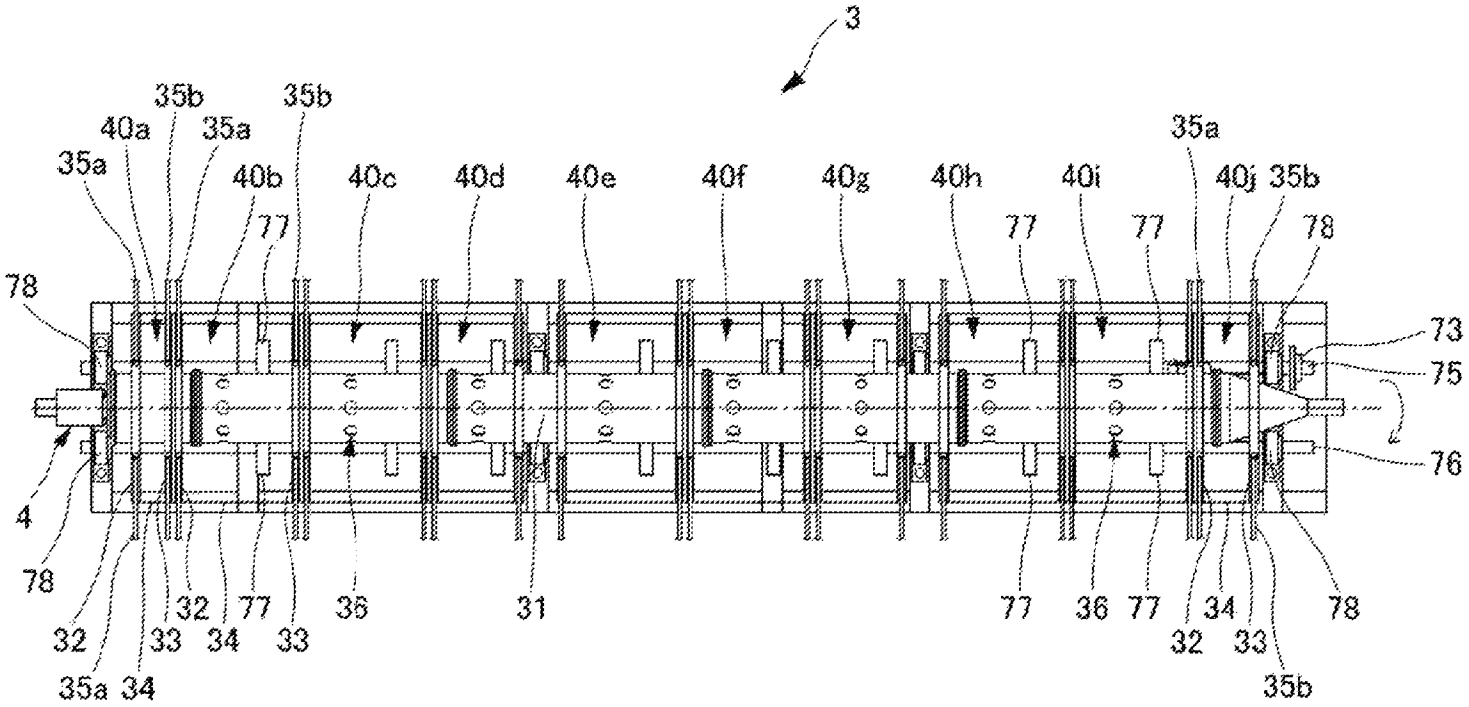
FIG. 4 is a plan view of a drying device of a vacuum freeze-drying apparatus according to an embodiment to the present invention.
Figure 5A:
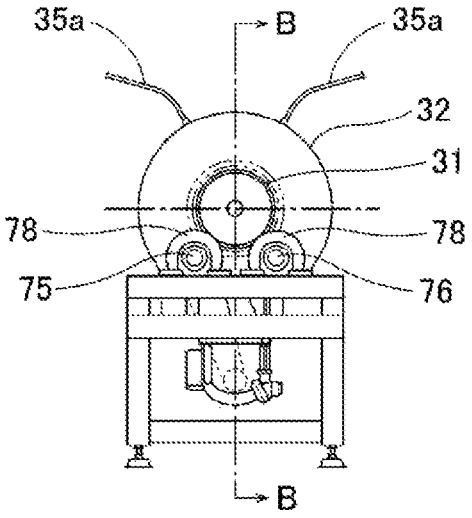
FIG. 5A is a left side view of a drying device.
Figure 5B:
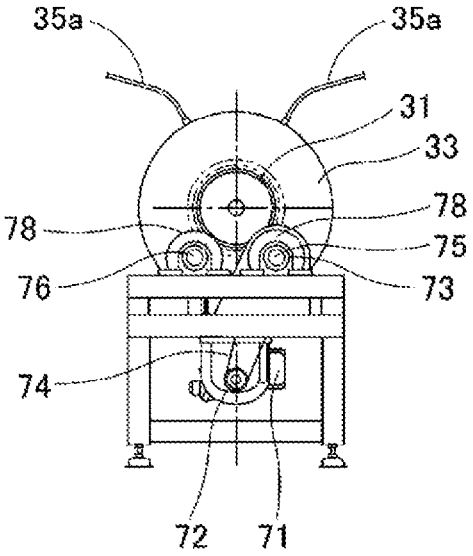
FIG. 5B is a right side view of a drying device.
Figure 6:
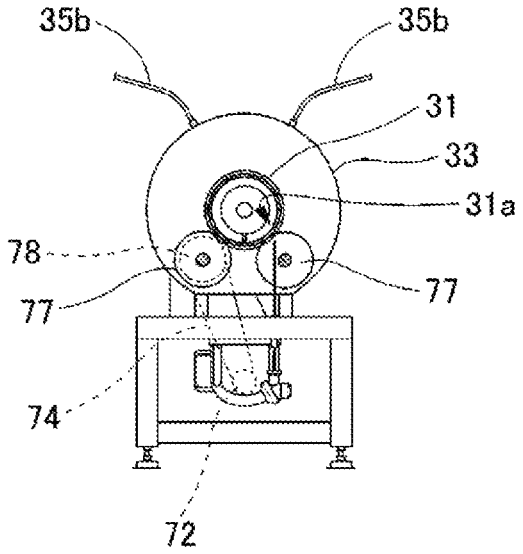
FIG. 6 is a cross-sectional view of a line from A to A of FIG. 1.

FIG. 3 is a front view of a drying device of a vacuum freeze-drying apparatus related to an embodiment of the present invention. FIG. 4 is a plan view of a drying device of a vacuum freeze-drying apparatus according to an embodiment of the present invention. FIG. 5A is a left side view of a drying device and FIG. 5B is a right side view of a drying device. FIG. 6 is a cross-sectional view of a line from A to A of FIG. 1.

As shown in FIGS. 1 to 6, a drying device 3 is provided with a tubular member 31, a temperature adjusting means 30*a* to 30*j*, a rotating portion 7, and a temperature control unit 8.

A tubular member 31 is formed of a tubular shape extending in a linear manner in a horizontal direction, having an opening, provided with an inlet portion 31*b* for letting a frozen substance enter into, and an outlet portion 31*c* for being an outlet for a dried material sublimated and dried (See FIG. 2).

In a tubular member 31, provided is a spiral transfer means 31*a* continuously provided adjacent to an inner wall of a tubular member 31 in a direction from an inlet portion 31*b* to an outlet portion 31*c*. A frozen substance transported from a connection portion 4 enters from an inlet portion 31*b* of a tubular member 31 and is transferred to an outlet portion 31*c* by a spiral transfer means 31*a*, during which a frozen substance is continuously sublimated and dried.

Temperature adjusting means 30*a* to 30*j* are provided in an outer peripheral portion of a tubular member 31 and adjust temperatures of a plurality of regions 40*a* to 40*j* in an outer surface of a tubular member 31.

A plurality of regions 40*a* to 40*j* are provided in a direction from an inlet portion 31*b* to an outlet portion 31*c* of a tubular member 31, temperatures thereof can be independently controlled. Temperature adjusting means 30*a* to 30*j* adjust temperatures of locations in a tubular member 31 corresponding to a plurality of regions 40*a* to 40*j*.

Here, ten temperature adjusting means 30*a* to 30*j* are provided, so are a plurality of regions formed by a temperature adjusting means 30*a* to 30*j*. It is preferred that a plurality of regions 40*a* to 40*j* have at least 3 or more regions. It is noted that a plurality of a temperature adjusting means may be described collectively as a temperature adjusting means, or that each temperature adjusting means may be described as a temperature adjusting means respectively.

A rotating portion 7 is for rotating a tubular member 31, at the center of a pivot. As a tubular member 31 is rotated by a rotating portion 7, a frozen substance entering from an inlet portion 31*b* of a tubular member 31 is sequentially transferred through a spiral transfer means 31*a* toward an outlet portion 31*c* in a tubular member 31. During the course, a frozen substance is continuously sublimated and dried. A rotating portion 7 is configured to rotate only a tubular member 31 and not to rotate temperature adjusting means 30*a* to 30*j* outside a tubular member 31. Temperature adjusting means 30*a* to 30*j* are fixed not to rotate.

A temperature control unit 8 has functions of inputting and outputting information, and is for independently controlling a temperature adjusted by temperature adjusting means 30*a* to 30*j* for adjusting temperatures of a plurality of regions 40*a* to 40*j* formed in an outer surface of a tubular member 31.

Next, a temperature adjusting means 30*a* to 30*j* will be described.

As shown in FIG. 1 and FIG. 2, temperature adjusting means 30*a* to 30*j* can respectively and independently adjust a temperature of each outer space around a tubular member 31 and adjust a temperature of each space in a tubular member 31 respectively.

A temperature adjusting means 30*a* adjusts a temperature of a space of a region 40*a* and adjusts a temperature of a space in a tubular member 31 corresponding to a region 40*a*. In addition, a temperature adjusting means 30*b* adjusts a temperature of a space of a region 40*b* and adjusts a temperature of a space in a tubular member 31 corresponding to a region 40*b*. A temperature adjusting means 30*c* adjusts a temperature of a space of a region 40*c* and adjusts a temperature of a space in a tubular member 31 corresponding to a region 40*c*. Similarly, temperature adjusting means 30*d* to 30*j* adjust temperatures of spaces of regions 40*d* to 40*j* and adjust temperatures of spaces in a tubular member 31 corresponding to regions 40*d* to 40*j*.

A frozen substance entering from an inlet portion 31*b* of a tubular member 31 is continuously sublimated and dried by advancing through spaces where each temperature is adjusted by temperature adjusting means 30*a* to 30*j* respectively.

Next, an example of temperature adjusting means 30*a* to 30*j* will be specifically described with reference to FIGS. 3 to 6. Although a temperature adjusting means 30*b* will be described as an example, other temperature adjust means may be configured in a similar manner. A temperature adjusting means 30*b* comprises a wall portion 32 on the side of an inlet portion 31*b* of a tubular member 31, a wall portion 33 on the side of an outlet portion 31*c*, a cover 34 for covering a space surrounded by the wall portions 32 and 33 to surround a tubular member 31, and ducts 35*a* and 35*b* for supplying gas to a wall portion 32 or 33 respectively. Wall portions 32 and 33 are both in a circular shape. A cover 34 is formed by a material such as a transparent resin so that it can visualize an interior, and covers a space surrounded by a wall portion 32 and a wall portion 33. A wall portion 32 and a wall portion 33 are connected to ducts 35*a* and 35*b* so that ducts 35*a* and 35*b* can supply gas. Temperatures of a plurality of regions 40*a* to 40*j* is adjusted to each target temperature by gas so supplied.

An air blowing means (not shown) is connected to ducts 35*a* and 35*b*, and a temperature-controlled gas is supplied. By supplying gas from ducts 35*a* and 35*b* into regions 40*a* to 40*j* covered by a wall portion 32, a wall portion 33 and a cover 34, temperatures of a plurality of regions 40*a* to 40*j* are independently controlled. For example, air can be supplied as gas, but it is not limited to air.

Although gas is used as an example to describe temperature adjusting means 30*a* to 30*j*, it is not limited to gas, but an electrical heater, refrigerant, etc. can be used.

The inside of wall portions 32, 33 has a circular opening respectively matching an outer shape of a tubular member 31. The circular openings of wall portions 32, 33 are preferably close to an outer periphery of a tubular member 31.

Next, temperatures of a plurality of regions 40*a* to 40*j* will be described.

A plurality of regions 40*a* to 40*j* have at least three or more regions in a direction from an inlet portion 31*b* to an outlet portion 31*c* of a tubular member 31. These three or more regions include the following (1) to (3) temperature regions. A temperature region is defined as a temperature of a tubular member 31 itself, a tube at the time when the process gets to a stable operation state, by measuring a temperature of an outer surface of a tubular member 31 configured as a contact type and/or a non-contact type.

Included are at least (1) a first temperature region of a minus temperature, (2) a second temperature region in a range from the minus temperature to the minus temperature plus 40° C., and (3) a third temperature region of the upper limit of the second temperature region plus 20° C. or higher.

A minus temperature region of (1) refers to a negative temperature region, such as −40° C., −30° C., −20° C., etc.

A temperature region in a range from the minus temperature of (1) to the minus temperature plus 40° C. refers to a temperature region in a range from a negative temperature of (1) to plus 40° C. For example, when a temperature of a minus temperature region of (1) is−40° C., a temperature region of (2) becomes a temperature region in a range from −40° C. to 0° C., since −40° C. plus 40° C. equals 0° C. In addition, when a temperature of a minus temperature region of (1) is −20° C., a temperature region of (2) becomes a temperature region in a range from −20° C. to 20° C., since −20° C. plus 40° C. equals 20° C.

A temperature region of the upper limit of the second temperature region plus 20° C. or higher of (3) refers to, when an upper limit temperature of (2) is 0° C., a temperature region of 0° C. +20° C. or higher.

In a direction from an inlet portion 31*b* to an outlet portion 31*c* of a tubular member 31, a plurality of regions 40*a* to 40*j* include at least three regions of the above (1) to (3). A frozen substance or a dry substance is continuously sublimated and dried while a frozen substance or a dry substance is transferred by a transfer means 31*a* sequentially to locations in a tubular member 31 corresponding to a plurality of regions 40*a* to 40*j* including those (1) to (3) temperature regions.

Next, a tubular member 31 will be described.

A tubular member 31 is preferably made of stainless steel.

A tubular member 31 is formed of one tubular shape by connecting a plurality of tubular portions 31A to 31F with attachment portions 31G to 31K. A tubular member 31 may be formed in one tubular shape without providing an attachment portion. Tubular portions 31B, 31C, 31D, 31E are tubular portions of the same shape. A tubular portion 31A is one having a slightly shorter length. A tubular portion 31F is formed so that the cross-sectional shape becomes smaller toward the tip. Attachment portions 31G to 31K are connected firmly so that adjacent tubular portions do not come off.

As described above, a tubular member 31 is provided with a spiral transfer means 31*a* continuously provided adjacent to an inner wall of a tubular member 31 in a direction from an inlet portion 31*b* to an outlet portion 31*c*. The transfer means 31*a* can form a spiral shape by providing a wall portion or a groove in an inner periphery of a tubular member 31. The formation of a spiral shape also includes a method of embedding a screw in an inner periphery of a tubular member 31.

While a transfer means 31*a* transfers a frozen substance entering from an inlet portion 31*b* sequentially inside a tubular member 31 located in a plurality of regions 40*a* to 40*j*, a frozen substance is continuously sublimated and dried. A dry substance so sublimated and dried is guided to an outlet portion 31*c*.

Next, a configuration of a rotating portion will be described.

As shown in FIGS. 3 to 6, a rotating portion 7 is provided with a motor 71, pulleys 72, 73, a belt 74, rotational shafts 75, 76 and rotary rollers 77, 78.

A motor 71 is a rotational drive source. Pulleys 72, 73, a belt 74 and a rotational shafts 75, 76 function as a rotational drive transmitting portion for transmitting rotational drive. Rotary rollers 77, 78 are a rotation support portion for supporting rotation by a rotational drive transmitting portion. A rotation support portion may be configured by adding a bearing to rotary rollers 77, 78, or by replacing a rotary roller 77 with a bearing.

A belt 74 is hang on the pulleys 72 and 73. Rotational force of a motor 71 is transmitted via a belt 74. A rotary roller 77 is arranged below on both sides of a tubular member 31. A tubular member 31 is placed on a rotary roller 77 arranged on both sides.

A pulley 73 is attached near one end of a rotational shaft 75. A rotating roller 78 attached to a fixed base is provided inside a pulley 73, and another rotary roller 78 similarly attached to a fixed base is also provided at the other end of the rotating shaft 75 in the same manner as one end thereof. Eight rotary rollers 77 are attached to a rotational shaft 75 between rotary rollers 78 and 78.

A rotational shaft 76 has a rotary roller 78 attached to a fixed base on the one end, and another rotary roller 78 attached to a fixed base on the other. Between these rotary rollers 78 and 78, eight rotary rollers 77 are attached to a rotational shaft 76. Rotary rollers 77 attached to a rotational shaft 75 are driving rollers, while rotary rollers 77 attached to a rotational shaft 76 are driven rollers.

When a motor 71 rotates, a belt 74 rotates through a pulley 72, a rotational shaft 75 rotates by a rotation of a pulley 73, and a rotary roller 77 fixed to a rotational shaft 75 rotates. By doing so, a tubular member 31 rotates, and a rotary roller 77 attached to a rotational shaft 76 rotates as a driven roller.

Next, a rotation speed of a tubular member 31 will be described.

It is preferred that a tubular member 31 rotates by a rotating portion 7 at a rotation speed of 1/30 rpm or more and 1 rpm or less.

Next, a temperature detection unit and a moisture detection unit will be described.

As shown in FIGS. 3 and 4, a tubular member 31 has glass windows (window portion) 36 continuously provided at a certain intervals in a circumferential direction, and the glass windows 36 are provided at a plurality of locations (eight locations in the present embodiment) in a longitudinal direction of a tubular member 31. The glass window 36 is provided so that a state of a substance inside can be recognized and detected from outside. A glass window 36 can be made of resin.

A detection unit 37 is provided at the lower portion of a tubular member 31 where a glass window 36 is provided in a circumferential direction. A detection unit 37 includes at least three types, a temperature detection unit for detecting a temperature of a substance inside a tubular member 31, a temperature detection unit for detecting a temperature of an outer surface (wall surface) of a tubular member 31, and a moisture detection unit for detecting the amount of moisture of a substance inside a tubular member 31.

When a detection unit 37 functions as a temperature detection unit for detecting a temperature of a substance inside a tubular member 31, it can be configured as a contact type or a non-contact type. When a detection unit 37 functioning as a temperature detection unit is a contact type, it detects a surface temperature of a tubular member 31. When a detection unit 37 functioning as a temperature detection units is a contact-less type, it detects a temperature of a substance inside a tubular member 31 through a glass window 36 of a tubular member 31.

A temperature control unit 8 is capable of independently controlling a temperature adjusted by a temperature adjusting means 30*a* to 30*j*, according to a surface temperature of a tubular member 31 or a temperature of a substance inside a tubular member 31 through a glass window 36 detected by a detection unit 37.

Further, when a detection unit 37 functions as a moisture detection unit for detecting the amount of moisture of a substance inside a tubular member 31, it is capable of detecting moisture content of a substance inside a tubular member 31 through a transparent glass window 36. A temperature control unit 8 is capable of independently controlling a temperature adjusted by a temperature adjusting means 30*a* to 30*j*, according to the amount of moisture of a substance inside a tubular member 31 detected by a detection unit 37.

Figure 9:
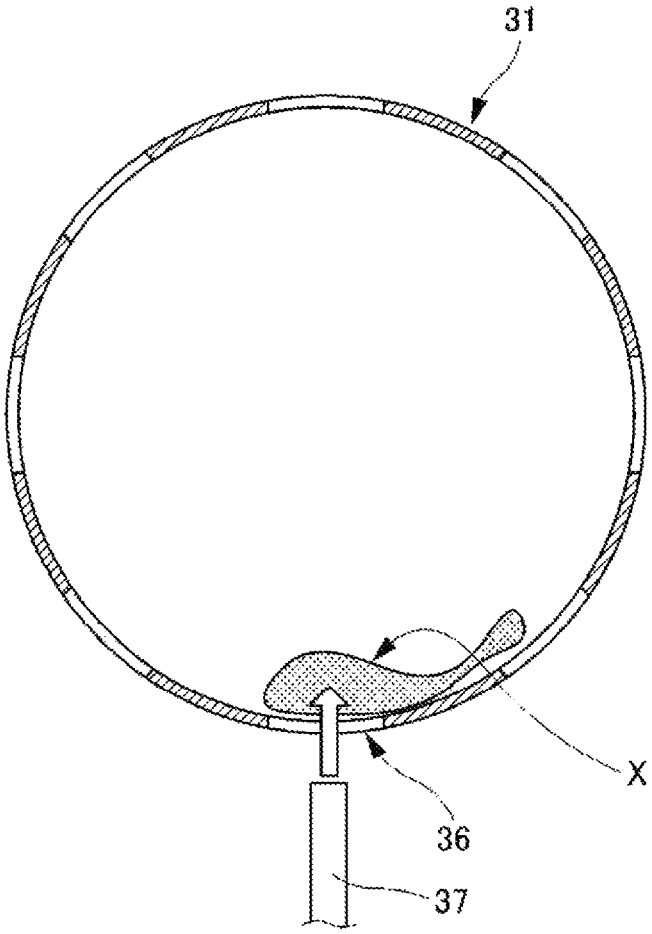
FIG. 9 shows how a detection unit detects a temperature of substance or the amount of moisture of a substance inside.

FIG. 9 shows how a detection unit detects a temperature of a substance or the amount of moisture of a substance inside.

As shown in FIG. 9, a detection unit 37 is capable of detecting temperature of a substance X inside a tubular member 31 and moisture content of a substance inside a tubular member 31 through a transparent glass window 36 of a tubular member 31, when functioning as a temperature detection unit for detecting a temperature of a substance inside a tubular member 31 and as a moisture detection unit for detecting the amount of moisture of a substance inside a tubular member 31.

A detection unit 37 is capable of detecting a temperature of a substance X inside a tubular member 31 and the amount of moisture of a substance inside a tubular member 31 through a transparent glass window 36 provided at a certain intervals in a circumferential direction of a tubular member 31 respectively. In addition, since glass windows 36 and detection units 37 are provided at a plurality of positions in a longitudinal direction of a tubular member 31, a temperature and the amount of moisture of a substance can be accurately detected at each position of the tubular member 31 respectively.

Next, a transfer means 31*a* will be described.

Figure 7A:
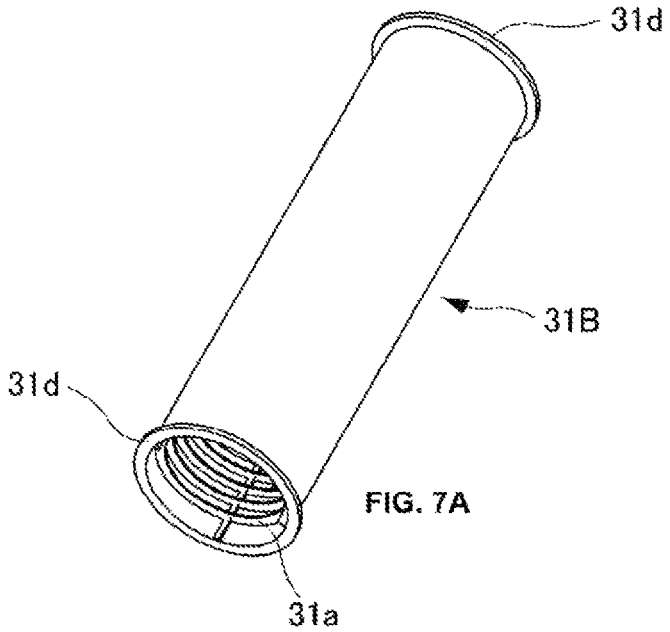
FIGS. 7A-7E show a tubular portion 31B among a plurality of tubular portions 31A to 31F constituting a tubular member 31.
Figure 7C:
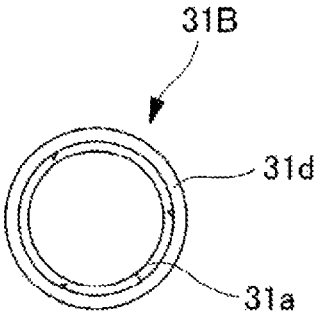
Figure 7B:
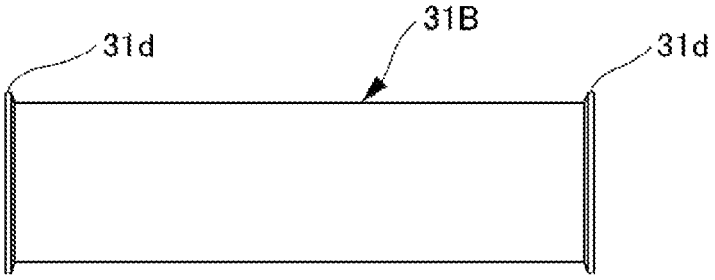
Figure 7D:
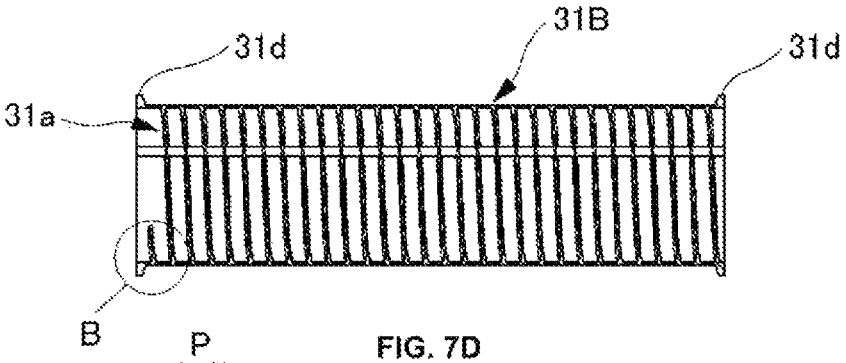
Figure 7E:
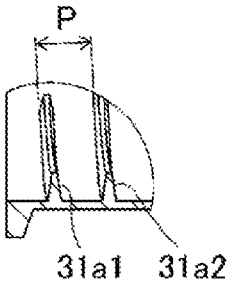
Figure 8:
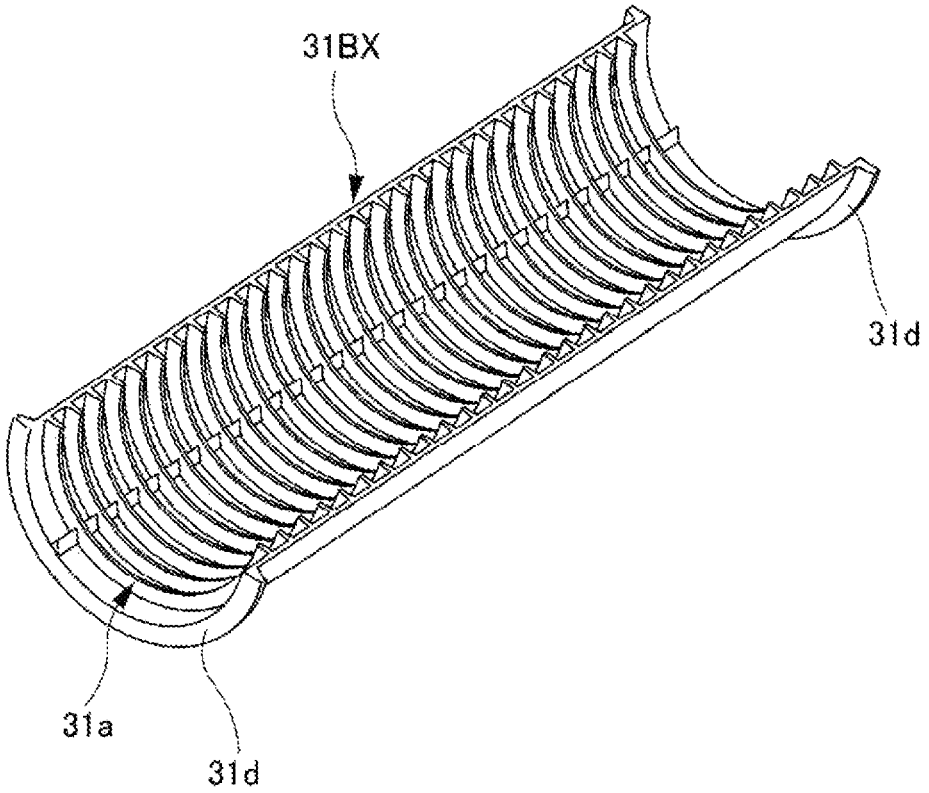
FIG. 8 shows a half body 31BX of a tubular portion 31B.

FIGS. 7A-7E show a tubular portion 31B among a plurality of tubular portions 31A to 31F constituting a tubular member 31. FIG. 7A is a perspective view of a tubular portion 31B shown in FIG. 3, FIG. 7B is a front view of a tubular portion 31B, FIG. 7C is a side view of a tubular portion 31B, FIG. 7D is a cross-sectional view of a tubular portion 31B, and FIG. 7E is a figure enlarging a B portion of FIG. 7D. FIG. 8 shows a half body 31BX of a tubular portion 31B.

FIGS. 7A-7E and 8 show a tubular portion 31B in FIG. 3. However, since their descriptions center on a spiral transfer means 31*a*, a glass window 36 is omitted.

As shown in FIGS. 7A-7E and 8, a tubular portion 31B constituting a tubular member 31 is formed of a tubular shape, and an edge portion 31*d* is formed protruding in a radial direction in both sides of an opening end. One tubular member 31 is formed by fixing edge portions 31*d* of adjacent tubular portions of 31A to 31F each other. The edge portions 31*d* of adjacent tubular portions of 31A to 31F are fixed by connecting ferrules, clamping, or bolting.

A part of a spiral transfer means 31*a* is continuously formed in a tubular portion 31B from one end to the other.

As shown in FIG. 7E, a wall portion is continuously formed in an inner wall of a tubular portion 31BX as a part of a transfer means 31*a*, such as a wall portion 31*a*1 in first lap and a wall portion 31*a*2 in a second lap. As a result, a part of a transfer means 31*a* can be formed in a tubular portion 31BX.

The height of a wall portion 31*a*1 and a wall portion 31*a*2 is the height of a transfer means 31*a*, and is preferably configured in a range of, for example, 3 mm or more and 50 mm or less.

The pitch of a wall portion 31*a*1 and a wall portion 31*a*2 is the pitch of a spiral transfer means 31*a*, and is preferably configured in a range of, for example, 5 mm or more and 20 mm or less.

FIG. 8 shows a half body 31BX of a tubular portion 31B by combining two of half bodies 31BX. A half body 31BX of a tubular portion 31B is capable of forming a part of a spiral transfer means 31*a* in a tubular portion 31B when the two are combined.

Figure 10:
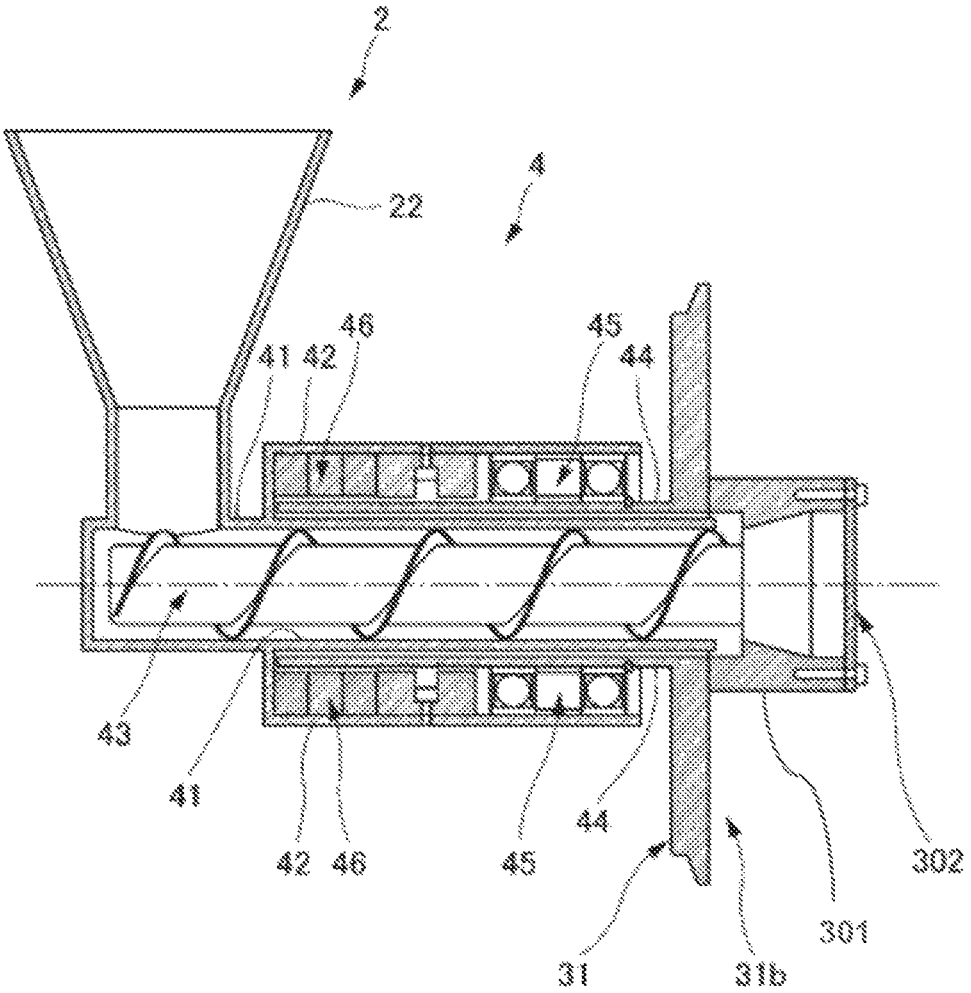
FIG. 10 is a cross-sectional view of a connection portion of a vacuum freeze-drying apparatus according to an embodiment of the present invention.

FIG. 10 is a cross-sectional view of a connection portion of a vacuum freeze-drying apparatus according to an embodiment of the present invention.

As shown in FIG. 10, a connection portion 4 is provided between a collection portion 22 of a vacuum freezing device 2 and an end portion in an inlet 31*b* side of a drying device 3, so that a frozen substance produced by a vacuum freezing device 2 can be transported to a drying device 3. Near an end portion 301, a receiving port 302 is provided for receiving a frozen substance transported by a connection portion 4.

A connection portion 4 comprises an inner pipe portion 41, an outer pipe portion 42, a screw 43 provided in an inner pipe portion 4, and an intermediate pipe portion 44 extending from an end portion 301 of a drying device 3 to an inner pipe portion 41 and an outer pipe portion 42 of a connection portion 4. A bearing 45 and an air seal 46 from a drying device 3 side are provided between an outer pipe portion 42 and an intermediate pipe portion 44.

An air seal 46 seals a rotating shaft by supplying air from a flow path without contacting a rotating shaft.

Figure 11:
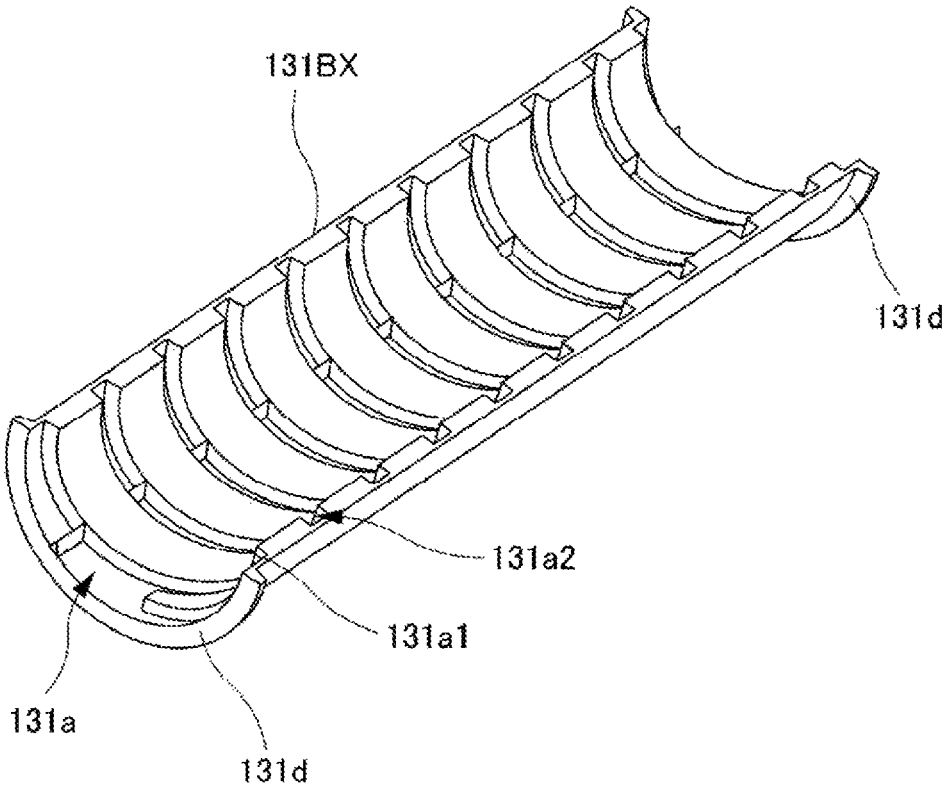
FIG. 11 is a diagram showing another example of a half body 31BX of a tubular portion 31B in FIGS. 7A-7E.

FIG. 11 is a diagram showing another example of a half body 31BX of a tubular portion 31B in FIGS. 7A-7E.

In examples shown in FIGS. 7A-7E and 8, a wall portion is formed in an inner wall of a tubular member 31 to form a transfer means 31*a*. But as shown in FIG. 11, a groove portions 131*a*1, 131*a*2 . . . can be formed in an inner wall of a tubular member 31 to form a transfer means 131*a*.

A tubular portion 31B is capable of forming one tubular portion 31B by connecting two half bodies 131BX of a tubular portion 31B. When two half bodies 131BX of a tubular portion 31B are coupled, a groove portion forming a spiral transfer means 131*a* is formed continuously and respectively. The depth of a groove portion 131*a*1 and a groove portion 131*a*2 is the depth of a transfer means 131*a*, and is preferably configured in a range of, for example, 3 mm or more and 50 mm or less. The pitch of groove portions 131*a*1 and 131*a*2 is the pitch of a transfer means 131*a*, and is preferably configured in a range of, for example, 5 mm or more and 20 mm or less. 131*d* is an edge portion, same as 31*d* in FIG. 8.

By forming a spiral groove portion in an inner periphery surface of a tubular member 31 as a transfer means 131*a* centered on a rotating shaft, a spiral feeding action is imparted to the inside of a tubular member 31, and a frozen substance or a dry substance can be transferred continuously.

According to the present embodiment, it is possible to provide a vacuum freeze-drying apparatus and a vacuum freeze-drying method, capable of continuously performing vacuum freeze-drying in a short time.

A vacuum freeze-drying method of the present embodiment includes a vacuum freezing step of freezing a liquid, a drying step of sublimating and drying a frozen substance frozen as above, and a step of performing vacuum suction through an exhaust path. Included in the drying step is a tubular member formed of a tubular shape having an inlet portion 31*b* and an outlet portion 31*c*, comprising a step of rotating a tubular member 31 having a spiral transfer means 31*a* continuously provided adjacent to an inner wall of a tubular member 31 in a direction from an inlet portion 31*b* to an outlet portion 31*c*, a step of adjusting temperatures of a plurality of regions provided in a direction from an inlet portion 31*b* to an outlet portion 31*c* in a peripheral portion of a tubular member 31, where the plurality of regions are at least three or more regions 40*a* to 40*j* whose temperature is capable of being controlled, and a step of continuously sublimating and drying the frozen substance while the frozen substance entering from an inlet portion 31*b* is transferred sequentially to locations corresponding to a plurality of regions 30*a* to 30*j* in a tubular member 31 by a transfer means 31*a*.

Although the present invention has been described above using embodiments, it goes without saying that the technical scope of the present invention is not limited to the scope of the above embodiments, and various changes or improvements are made to the above embodiments. It is clear to those skilled in the art that is possible. Further, it is clear from the description of the scope of claims that the form to which such a modification or improvement is added may be included in the technical scope of the present invention.

INDEXES

1 Vacuum freeze-drying apparatus
2 Vacuum freezing device

3 Drying device
6 Clean air
7 Rotating portion
8 Temperature control unit
30*a* to 30*j* Temperature adjusting means
31 Tubular member
31*a* Spiral transfer means
36 Glass window (window portion)
37 Detection unit (temperature detection portion, moisture detection portion)
40*a* to 40*j* Regions
46 Air seal

The invention claimed is:

1. A vacuum freeze-drying apparatus comprising:

a vacuum freezing device for freezing a liquid, a drying device for sublimating and drying a frozen substance frozen by the vacuum freezing device, an exhaust path for performing vacuum suction in order to create a reduced pressure atmosphere inside the vacuum freezing device and the drying device, and a connection portion for connecting the vacuum freezing device and the drying device, wherein the connection portion comprises a first pipe portion in a side of the vacuum freezing device, a second pipe portion in a side of the drying device, and a seal portion for sealing between the first pipe portion and the second pipe portion, wherein the drying device is provided with an inlet portion and an outlet portion, and comprises:

one tubular member formed of a tubular shape, a temperature adjusting means for respectively adjusting temperatures of a plurality of regions in an outer surface of the tubular member provided in a plurality of regions in a direction from the inlet portion to the outlet portion in a peripheral portion of the tubular member, wherein the plurality of regions are at least three or more regions whose temperature is capable of being controlled, a temperature control unit for independently and respectively controlling the temperature of the plurality of regions adjusted by the temperature adjusting means, and a rotating portion for rotating the tubular member, wherein the tubular member has a spiral transfer means continuously provided in an inner wall of the tubular member in a direction from the inlet portion to the outlet portion, the tubular member comprises a plurality of tubular portions and an attachment portion for coupling the plurality of tubular portions, the temperature adjusting means is provided in each of the plurality of regions in the peripheral portion of the tubular member, and comprises a first wall portion, a second wall portion, a cover for covering a space surrounded by the first wall portion and the second wall portion as the region, and a supply means for supplying gas into the region, the cover covering so as to surround at least a portion of the tubular member having the plurality of tubular portions and the attachment portion, and the spiral transfer means, by having the rotating portion rotate the tubular member, under a reduced pressure atmosphere inside the vacuum freezing device and the drying device, transfers the frozen substance entering from the vacuum freezing device sequentially to locations corresponding to the plurality of regions in the tubular member to continuously sublimate and dry the frozen substance.

2. The drying device according to claim 1, wherein the plurality of regions of the three or more regions comprise at least a first temperature region of a minus temperature, a second temperature region in a range from the minus temperature to the minus temperature plus 40° C., and a third temperature region of the upper limit of the second temperature region plus 20° C. or higher, provided in a direction from the inlet portion to the outlet portion respectively.

3. The drying device according to claim 1, wherein a substance produced therefrom is an injectable substance or a drug in solid formulation, and a periphery of the tubular member is covered with clean air.

4. The drying device according to claim 1, wherein the rotating portion comprises a rotational drive transmitting portion for transmitting a rotational drive provided in one or a plurality of locations in an axial direction, and a rotation support portion configured by a rotary roller and/or a bearing for supporting rotation by the rotational drive transmitting portion.

5. The drying device according to claim 1, wherein the rotating portion has a rotation speed of 1/30 rpm or more and 1 rpm or less.

6. The drying device according to claim 1, wherein the spiral transfer means is formed by providing a wall portion in a spiral form in the inner wall of the tubular member.

7. The drying device according to claim 1, wherein the spiral transfer means is configured by a groove portion formed in the inner wall of the tubular member, and a depth of the groove portion is 3 mm or more and 50 mm or less.

8. The drying device according to claim 1, wherein the tubular member is provided with a contact type or non-contact type temperature detection portion, and the temperature control unit controls a temperature adjusted by the temperature adjusting means according to a surface temperature of the tubular member or a temperature of a substance in the tubular member detected by the temperature detection portion.

9. The drying device according to claim 1, wherein a moisture detection unit is provided outside the tubular member for detecting moisture content of a substance in the tubular member through a transparent glass or resin window portion, and the temperature control unit controls a temperature adjusted by the temperature adjusting means according to an amount of moisture of the substance in the tubular member detected by a moisture detection portion.

10. The drying device according to claim 1, wherein the tubular member is made of stainless steel.

11. A vacuum freeze-drying method comprising a vacuum freezing step of freezing a liquid by a vacuum freezing device to obtain a frozen substance, a drying step of sublimating and drying the frozen substance by a drying device, and a step of performing vacuum suction through an exhaust path in order to create a reduced pressure atmosphere inside the vacuum freezing device and the drying device, wherein a connection portion is provided for connecting the vacuum freezing device and the drying device, and the connection portion comprises a first pipe portion in a side of the vacuum freezing device, a second pipe portion in a side of the drying device, and a seal portion for sealing between the first pipe portion and the second pipe portion, wherein the drying step comprises:

a step of rotating one tubular member formed of a tubular shape provided with an inlet portion and an outlet portion, and comprising a spiral transfer means continuously provided in an inner wall of the tubular member in a direction from the inlet portion to the outlet portion, a step of respectively adjusting temperatures of a plurality of regions provided in a direction from the inlet portion to the outlet portion in a peripheral portion of the tubular member, wherein the plurality of regions are at least three or more regions whose temperature is capable of being controlled, and a step of continuously sublimating and drying the frozen substance, by having a rotating portion rotate the tubular member, under the reduced pressure atmosphere inside the vacuum freezing device and the drying device, and transferring the frozen substance entering from the vacuum freezing device sequentially to locations corresponding to a plurality of regions in the tubular member, wherein the tubular member comprises a plurality of tubular portions and an attachment portion for coupling the plurality of tubular portions, and a temperature adjusting means is provided in each of the plurality of regions in the peripheral portion of the tubular member, and comprises a first wall portion, a second wall portion, a cover for covering a space surrounded by the first wall portion and the second wall portion as the region, and a supply means for supplying gas into the region, the cover covering so as to surround at least a part of the tubular member having the plurality of tubular portions and the attachment portion.

* * * * *